US006258255B1

(12) United States Patent
Gale et al.

(10) Patent No.: US 6,258,255 B1
(45) Date of Patent: Jul. 10, 2001

(54) METHOD FOR ENHANCING ASPHALT PROPERTIES

(75) Inventors: Mary Josephine Gale, Forest; Lyle Edwin Moran, Sarnia; James David Bell, Toronto; Biddanda Umesh Achia, Sarnia, all of (CA)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/430,802

(22) Filed: Oct. 29, 1999

(51) Int. Cl.[7] ..... C10C 3/02

(52) U.S. Cl. ..... 208/44; 208/304

(58) Field of Search ..... 208/45, 309

(56) References Cited

U.S. PATENT DOCUMENTS 2,319,750 * 5/1943 Schonberg et al. ..... 196/72

* cited by examiner

*Primary Examiner*—Helane Myers
(74) *Attorney, Agent, or Firm*—Linda M. Scuorzo

(57) ABSTRACT

The invention relates to a method for making an asphalt product having an enhanced flash point and lower volatility, comprising vacuum distilling a blend of a high boiling petroleum fraction having an initial boiling point of at least 270° C. and a crude to produce a product asphalt having a flash of from 265° C. to 300° C.

10 Claims, 2 Drawing Sheets

METHOD FOR ENHANCING ASPHALT PROPERTIES

FIELD OF THE INVENTION

The present invention relates to a method for enhancing asphalt product properties.

BACKGROUND OF THE INVENTION

There is a continuing need for enhancing the volatility and flash of certain distillation residues, for use to meet specifications for roofing and paving asphalts. This should be accomplished without degradation of other desirable properties of the product asphalt. Applicants' invention addresses these needs.

SUMMARY OF THE INVENTION

An embodiment of the invention provides for a method for enhancing asphalt product properties, particularly flash and volatility. Beneficially the resulting asphalts are more useful in the production of roofing materials or paving materials wherein asphalt is commonly used as the bonding agent.

The present invention may comprise, consist or consist essentially of the steps or elements disclosed herein and may be practiced in the absence of a limitation not disclosed as required.

DETAILED DESCRIPTION OF THE INVENTION

The production of certain asphalts such as paving asphalts for low temperature applications and roofing asphalt flux requires a soft asphalt, typically a 200/400 penetration grade (pen at 25° C.) or softer and having a viscosity of about 500 to 1500 centistokes (cSt at 100° C.). Thereafter, these asphalts may be directly used in paving applications, either neat or modified (e.g., with polymer) or subjected to an additional (e.g., oxidizing) treatment to meet required specifications for roofing applications.

A feature of asphalt fluxes made from certain starting crudes or residua is that they often have an unacceptably low flash point, typically below 265° C., and unacceptably high mass loss, typically greater than 0.5 to 1 wt % upon heating to 163° C. for 5 hours, such as in a Thin Film Oven Test. These deficiencies in flash point and mass loss typically occur in soft paving asphalts (e.g., 200/300 and 300/400 penetration grade; also designated as AC-5 or AC-2.5 for viscosity-graded asphalt in the USA). For example, those asphalts made from crudes such as Cold Lake and Lloydminster, which have a high asphaltene content (typically>15%), skewed boiling point distribution and high boiling back end (typically>700° C.). A flash point below 265° C. can cause limitations when the asphalt product is utilized in roofing applications by causing flash fires. The flash point can be determined by well-known analytical methods (ASTM D 92, Cleveland Open Cup Flash Point Method).

Treatment of the atmospheric or vacuum residua from the aforementioned starting crudes by the process of the present invention produces treated product having the desired flash point of at least 265° C., while at the same time as having other desirable properties such as good weatherability for roofing asphalts and good viscosity-penetation characteristics with low mass loss for paving asphalts.

Figure 1:
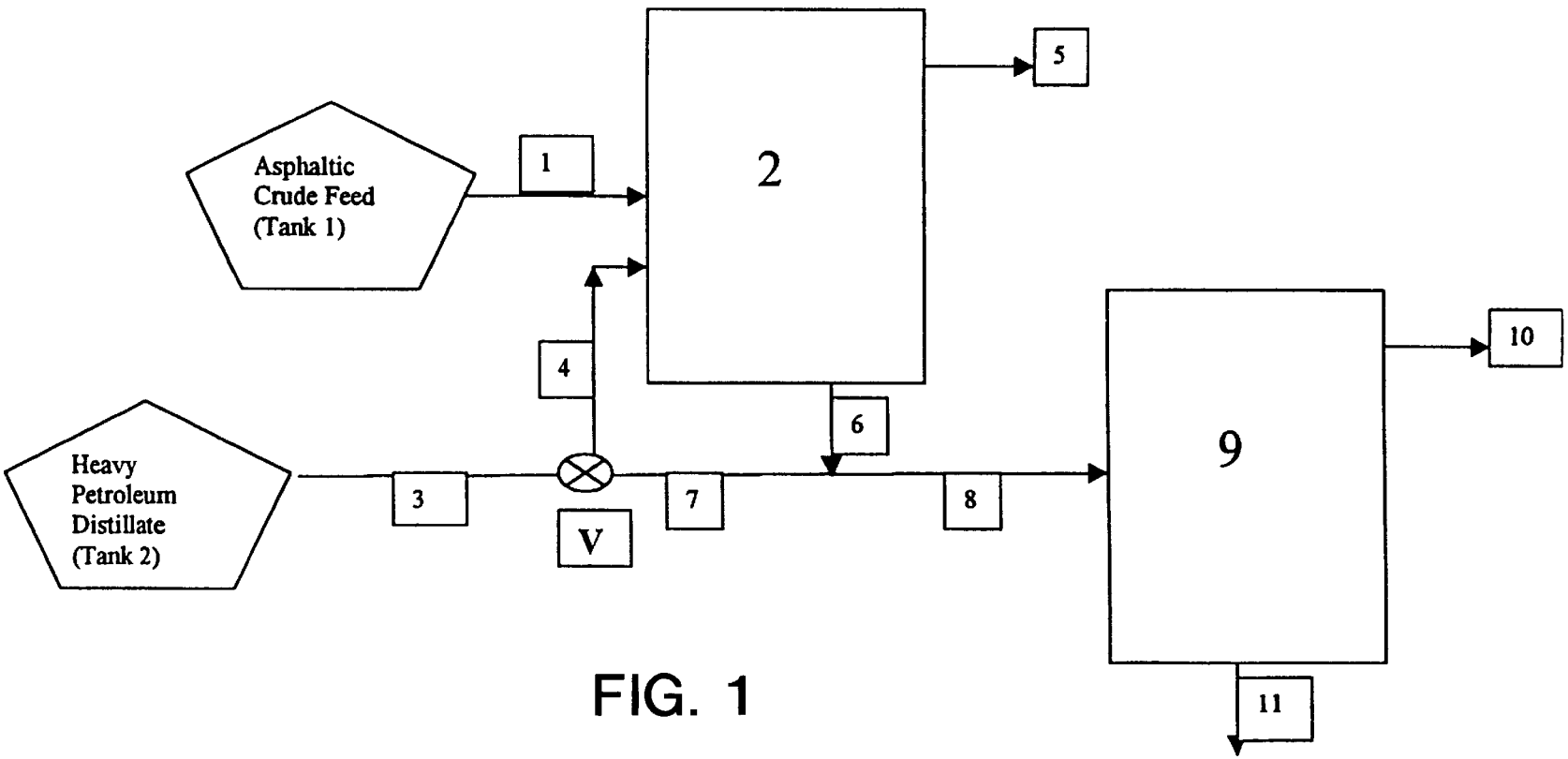
FIG. 1 shows an embodiment of codistillation process of this invention.

FIG. 1 describes an embodiment of the process for codistillating of a crude with a heavy petroleum distillate to produce a product asphalt having enhanced flash point A crude feed is introduced via line 1 to an atmospheric distillation zone 2. All or a portion of a heavy petroleum distillate is cointroduced via line 3 through line 4 to the aUnospheric distillation zone 2. When only a portion of the heavy petroleum distillate is to be so introduced, line 3 is outfitted with a flow controller, V, to control such introduction. The atmospheric distillation zone produces an overhead fraction recovered through line 5 and a bottom fraction recovered through line 6. Any portion of the heavy petroleum distillate not so introduced via line 3 and flow controller V to line 4 into the atmospheric distillation zone 2 is fed via line 7 and introduced with the bottoms fraction from line 6 via line 8 to a vacuum distillation zone 9. In zone 9, the crude is fractionated as known in the art by application of heat and under vacuum at conditions sufficient to inhibit thermal cracldng from which is recovered an overhead fraction via line 10 and a vacuum residue (product asphalt) via line 11.

The vacuum residue (product asphalt) is useful in asphalt manufacture. The cutpoint of the vacuum residue, which may range from 400° C. to 550° C., typically governs the quality of the asphalt (properties such as penetration and viscosity). In a preferred embodiment of this invention, all of heavy petroleum distillate is fed to zone 9 through the flow controller set appropriately. The cutpoint in the vacuum distillation zone may range from 430° C. to 490° C. The heavy distillate stream may be sent to the atmospheric distillation zone 2 if some restriction, such as a hydraulic restriction, exists in its introduction to the vacuum distillation zone 9.

Thus, the resulting treated asphalt product has an enhanced flash over that produced by vacuum distillation alone of the same starting crude and also over that produced by simple blending of the starting crude residuum with the aforementioned heavy distillate. The products produced by Applicants' process also desirably have the following properties: kinematic viscosity of 500–1000 cSt at 100° C.; absolute viscosity of 200–300 Pa.s at 60° C. and a penetration of 300–400 dmm at 25° C. These products desirably meet CSA roofing specifications (Canadian Standards Association given in Table 1) and CGSB paving specifications for 200–400 pen asphalt (Canadian General Standards Board, given in Table 2).

Additionally, paving grade asphalts are being required to meet the evolving SUPERPAVE specifications now being implemented in the United States of America, Canada and many parts of the world. One key requirement is to meet a mass loss specification of less than 1.0 wt %, an aspect particularly addressed by the Applicants' invention.

TABLE 1

CSA REQUIREMENTS FOR ASPHALT FOR CONSTRUCTING BUILT-UP ROOF COVERINGS AND DAMPPROOFING AND WATERPROOFING SYSTEMS

| | Type 1 | | Type 2 | | Type 3 | |
|---|---|---|---|---|---|---|
| Property | Minimum | Maximum | Minimum | Maximum | Minimum | Maximum |
| Softening Point (Ring-and-Ball Method) ° C. | 60 | 68 | 75 | 83 | 90 | 98 |
| Flash Point (Cleveland Open Cup Method) ° C. | 230 | — | 230 | — | 230 | — |
| Penetration, dmm | | | | | | |
| 0° C., 200 g, 60 s | 10 | — | 10 | — | 8 | — |
| 25° C., 100 g, 5 s | 30 | 45 | 20 | 30 | 15 | 25 |
| 45° C., 50 g, 5 s | — | 160 | — | 80 | — | 55 |
| Loss on Heating at 163° C. (50 g, 5 h), percent | — | 1.0 | — | 1.0 | — | 1.0 |
| Penetration of Residue, percent of original | 80 | — | 80 | — | 80 | — |
| Material Soluble in Trichloroethylene, percent | 99 | — | 99 | — | 99 | — |

TABLE 2

CGSB REQUIREMENTS FOR PAVING ASPHALTS

| | 200/300 Penetration | | 300/400 Penetration | | Test Method | |
|---|---|---|---|---|---|---|
| Property | Minimum | Maximum | Minimum | Maximum | ASTM | |
| Penetration at 25° C., 100 g, 5 s, 0.1 mm | 200 | 300 | 300 | 400 | D 5 | |
| Flash Point (Cleveland Open Cup Method) ° C. | 175 | — | 175 | — | D 92 | |
| Thin film oven test, % loss in mass | — | 1.5 | — | 1.5 | D 1754 | |
| Penetration of Residue, percent of original | 37 | — | 35 | — | | |
| Material Soluble in Trichloroethylene, percent | 99.0 | — | 99.0 | — | D 2042 | |
| PENETRATION, dmm | 200 | | 300 | | 400 | |
| VISCOSITY REQUIREMENTS*, Min. for Grade requirements | cSt | Pa · s | cSt | Pa · s | cSt | Pa · s |
| Grade 'A' | 185 | 50 | 145 | 31 | 120 | 21.5 |
| Grade 'B' | 145 | 39 | 115 | 24.5 | 95 | 17.5 |
| Grade 'C' | 84 | 23 | 60 | 14.5 | 46 | 8.8 |

*Viscosity at 60° C., Pa · s OR Viscosity at 135° C., cSt (not both)

The present invention provides for a method for enhancing the quality of a product asphalt used in paving or roofing applications, by vacuum distilling the starting crude or residuum with a sufficient amount of a high boiling petroleum distillate fraction having an initial boiling point of at least 270° C. The resulting product has an improved flash point within the range of 265–300° C. and a lower mass loss than products made with the starting crude alone. The high boiling fraction may come from a variety of sources, e.g., the heavy fraction from a light synthetic crude, a high boiling petroleum distillate such as heavy vacuum gas oil (HVGO), a heavy lube distillate or a deasphalted stock. Fractions boiling above 270° C. that are not suitable in this application are highly aromatic fractions that have been are catalytically or thermally cracked, such as streams from a catalytic cracking unit or a thermal coking unit of a refinery. While these streams may improve the flash satisfactorily, they degrade other properties such as viscosity and weatherability that is necessary for paving and roofing asphalts respectively. In the high boiling fractions, asphaltene content is essentially absent.

The asphaltic crude or residuum with which the high boiling fraction is blended typically has a skewed boiling distribution as shown in Table 3.

TABLE 3

PROPERTIES OF COLD LAKE DISTILLATION CUTS

| Vol % | Cut Temperature (° C.) (1) | Density at 15° C. (g/ml) | Viscosity at 100° C. (cSt) |
|---|---|---|---|
| 30.1 | i–232 | | |
| 2.5 | 232–260 | 0.8654 | <1.2 |
| 3.6 | 260–288 | 0.8851 | 1.367 |
| 2.8 | 288–316 | 0.9074 | 1.782 |
| 3.8 | 316–343 | 0.9268 | 2.506 |
| 0.1(2) | 343–371 | 0.9472 | 3.284 |
| 0.5(2) | 371–399 | 0.9472 | 4.354 |
| 3.2 | 399–427 | 0.9504 | 5.716 |
| 4.9 | 427–454 | 0.9590 | 7.686 |
| 48.5 | 454+ | | |

(1) Initial - 343° C. by 15/5 Distillation (ASTM D-2892)
(2) 343° C.+ then redisfilled by HIVAC (High Vacuum Distillation, ASTM D-5236)

Preferred high boiling fictions for use in the process are high boiling petroleum distillates such as heavy vacuum gas oil (HVGO) (typically 200–220° C. flash, 8–20 CSt at 100° C. viscosity, 0.90–0.92 g/cc density, boiling range of 400–650° C., hydrogen/carbon ratio of 1.6 to 1.75). Other suitable high boiling fractions may be substituted by one skilled in the art to achieve the aforementioned desired flash/volatility properties and meet specifications for roofing and paving product.

Table 4 shows the properties of representative high boiling petroleum fractions employed and Table 5 shows codistilled blends of asphaltic crude (Cold Lake) and 10% by volume of each of the high boiling petroleum fractions. The fractions ranged in typical properties such as boiling points (initial and 5% volume off), hydrogen-to-carbon molecular ratio and aromatics content.

TABLE 4

TYPICAL PROPERTIES OF DIFFERENT DISTILLATES

| Property | Petroleum Fraction | | | | |
|---|---|---|---|---|---|
| | Heavy Lube Distillate | Bottoms Atmosperic Gas Oil | Heavy Vacuum Gas Oil | Heavy Lube Extract | Catalytic Cracker Fractionator Bottoms |
| Column Number | 1 | 2 | 3 | 4 | 5 |
| Viscosity, cSt at 100° C. | 21 | 3.5–5 | 10–15 | 30 | 15–35 |
| GCD Boiling Temperatures, ° C. | | | | | |
| Initial | 413 | 283 | 292 | 428 | 191 |
| 50% volume off | 549 | 385 | 457 | 548 | 389 |
| Final | 643 | 430 | 624 | 687 | 564 |
| Aromatics, wt % | 69 | 65–70 | 65–75 | 87 | 97 |
| Hydrogen-to-Carbon Ratio | 1.6 | 1.7 | 1.6 | 1.3 | 0.9 |

The resulting products were tested against roofing specifications shown in Table 1 and paving specifications shown in Table 2.

TABLE 5

EFFECTS OF DIFFERENT DISTILLATES ON ASPHALT PROPERTIES
Product Targets: Flash point >265° C.; Meets Roofing CSA specifications; Meets CGSB "A", "B" Paving Asphalt Classification for viscosity at 60° C.

| Feedstock> Property | 100% Cold Lake Crude (CL) | Codistilled: 90% Cold Lake Crude + 10% of Petroleum fraction below | | | | |
|---|---|---|---|---|---|---|
| | | Heavy Lube Distillate (HLD) | Bottoms Atmospheric Gas Oil (BAGO) | Heavy Vacuum Gas Oil (HVGO) | Heavy Lube Extract (HLE) | Catalytic Cracker Fractionator Bottoms (CFB) |
| Column Number | 1 | 2 | 3 | 4 | 5 | 6 |
| Penetration @ 25° C. | 229–440 | 440 | 424 | 440 | 175 | 175 |
| Cut Temperature, ° C. | 408–427 | 436 | 440 | 436 | 457 | 431 |
| Yield, vol % | 52.7–56 | 55.5 | 50 | 56 | 55.4 | 55 |
| Flash, ° C. | 250–263 | 280 | 255 | 265 | 296 | 280 |
| Viscosity @ 100, ° C. | 800–1400 | 675 | 800 | 680 | 1500 | 1266 |
| TFOT mass loss, wt % | 0.8 to −.15 | 0.25 | 0.56 | 0.4 | 0.155 | 0.345 |
| Roofing CSA Specs | fail | pass | not done | pass | fail | fail |
| Paving CGSB Specs (for viscosity @ 60° C.) | All "A" grade | "A" @ >200 penetration | Meets "A" for all grades | Borderline "A" 300/400 | "B" for all grades | "B" for all grades |

The invention is demonstrated with reference to the following examples:

EXAMPLE 1

Cold Lake Crude (Column 1, Table 5)

Cold Lake crude was selected as the base crude since it is commonly used in asphalt production and due to its high yields of good quality asphalt. However, the deficiencies of the neat crude are the low flash (250 to 263° C.) over a range of cut temperatures, penetrations and viscosities, failure to meet roofing CSA viscosity/penetration specifications and a relatively high mass loss at high penetrations (soft asphalts such as 200/400 pen used in paving applications). To overcome these deficiencies, a number of codistillation candidates were tested at 10% by volume on crude.

EXAMPLE 2

Cold Lake Crude+10% Heavy Lube Distillate (Column 2, Table 5)

Heavy Lube Distillate (HLD) is a narrow-cut, heavy petroleum stream typically produced by vacuum fractionating crude for subsequent lubricant manufacture. Its moderate viscosity, low aromatics content and high carbon-to-hydrogen ratio characterize the stream (Column 1, Table 4). Column 2 in Table 5 shows that all products targets were satisfactorily met by codistilling Cold Lake crude with this fraction.

EXAMPLE 3

Cold Lake Crude+10% BAGO (Column 3, Table 5)

Bottoms Atmospheric Gas Oil (BAGO) is a petroleum stream typically produced by the atmospheric fractionation of crude for subsequent use in various refinery processes in clean product manufacture. Its relatively low viscosity, low aromatics content and high carbon-to-hydrogen ratio characterize the stream (Column 2, Table 4). While asphalt having satisfactory penetration was produced by codistillation with Cold Lake crude, the flash point of 255° C. did not meet the target Testing for roofing and paving asphalt specifications was not done (Column 3, Table 5).

EXAMPLE 4

Cold Lake Crude+10% HVGO (Column 4, Table 5)

Heavy Vacuum Gas Oil (HVGO) is a broad-cut petroleum stream typically produced by the vacuum fractionation of crude for subsequent use in various refinery processes for clean product manufacture. Its medium viscosity, low aromatics content and high carbon-to-hydrogen ratio characterizes the stream (Column 3, Table 4). Column 4 in Table 5 shows that all targets were satisfactorily met by codistilling Cold Lake crude with this fraction.

EXAMPLE 5

Cold Lake Crude+10% Heavy Lube Extract (Column 5, Table 5)

Heavy Lube Extract (HLE) is a petroleum stream typically produced by the solvent extraction of a heavy lube distillate during lube manufacture. Its relatively high viscosity, high aromatics content and low carbon-to-hydrogen ratio characterizes the stream (Column 4, Table 4). Column 5 in Table 5 shows that while the flash targets was met by codistilling Cold Lake crude with this faction, it failed to meet roofing specifications and paving grade was CGSB-"B" for all grades.

EXAMPLE 6

Cold Lake Crude+10% Catalytic Cracker Fractionator Bottoms (Column 6, Table 5)

Catalytic Cracker Fractionator Bottom (CFB) is a petroleum stream typically produced following the catalytic cracking of a petroleum distillate and subsequent fractionation of the product, the CFB being the heaviest fraction. Its moderate viscosity, very high aromatics content and very low carbon-to-hydrogen ratio characterizes the stream (Column 5, Table 4). Column 6 in Table 5 shows that while the flash target was met by codistilling Cold Lake crude with this fraction, it failed to meet roofing specifications and paving grade was CGSB-"B" for all grades.

The examples in Table 5 clearly indicate that the properties of the high boiling petroleum fraction selected for codisillation with a crude are important in providing a final asphalt product with suitable characteristics. HVGO and HLD (heavy Lube Distillate) clearly impart favorable properties when selected as the codistilate over the other candidates.

EXAMPLES 7 to 9

(Table 6, Columns 3, 4 and 5)

In addition to Example 4 where HVGO was employed at 10%, the use of HVGO at 15%, 20% and 25% volume basis on whole crude also produced asphalt products with acceptable flash and lower mass loss than the virgin crude alone (Column 1, Table 6). The products met the aforementioned product specifications for roofing and paving asphalts.

TABLE 6

EFFECT OF CODISTILLING COLD LAKE CRUDE WITH DIFFERENT AMOUNTS OF HEAVY VACUUM GAS OIL (HVGO)
Product Targets: At least 270° C. flash and meets (passes) roofing CSA specifications; meets CGSB Paving grade "A"/"B" classification for viscosity @ 60° C.

| Property | Cold Lake Crude | +10% HVGO | +15% HVGO | +20% HVGO | +25% HVGO |
|---|---|---|---|---|---|
| Column Number | 1 | 2 | 3 | 4 | 5 |
| Penetration @ 25° C. | 229–440 | 440 | 323 | 387 | 229 |
| Cut Temperature, ° C. | 408–427 | 436 | 440 | 455 | 475 |
| Yield, vol % | 52.7–56 | 56 | 51.7 | 50.7 | 46 |
| Flash, ° C. | 250–263 | 265 | 284 | 292 | 298 |
| Viscosity @ 100° C. | 800–1400 | 680 | 852 | 684 | 1131 |
| TFOT loss, wt % | 0.8 to −0.15 | 0.4 | 0.04 | 0.07 | 0.1 |
| Roofing CSA Specs | fail | Pass | pass | pass | pass |
| Paving CGSB Specs | All "A" Grade | Borderline "A" 300/400 | "B" for 300/400 | "B" for 200/300 and 300/400 | "B" for 200/300 and 300/400 |

Other codistillates, with properties similar to HVGO and employed within the same range could be expected to perform similarly.

Figure 2:
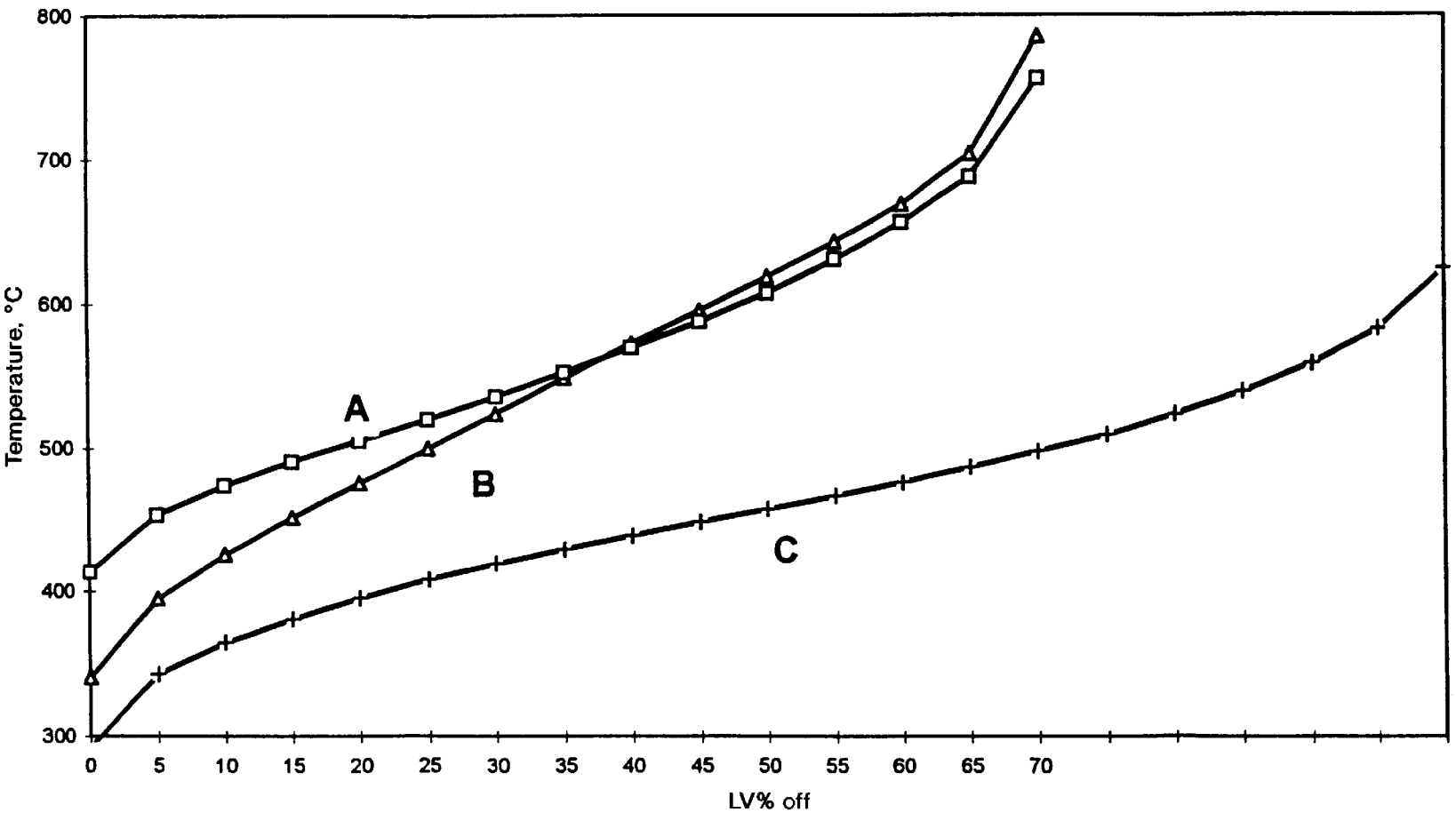
FIG. 2 is a boiling point distribution plot of liquid volume (LV %) on the x-axis versus temperature (° C.) on the y-axis for codistilled Cold Lake crude plus 25% HVGO (A), Cold Lake 229 pen neat (B) and HVGO neat (C); and shows the unexpected enhanced effect on the front end boiling point of codistillation in line (A).

FIG. 2 demonstrates the benefit of codistilling Cold Lake crude with a high boiling fraction according to the process disclosed herein, the boiling point distribution of the resulting product (A) in comparison to neat Cold Lake crude (B) and neat HVGO (C).

Beneficially, the codistillation process produces low volatility and high flash product asphalts comparable to those from heavy crudes that yield products having more desirable flash/volatility properties (e.g., Arabian crudes like Arab Heavy and Arab Medium; Canadian crudes like Bow River, Pembina, Boundary Lake; and Venezuelan crudes like BCF-22). Advantageously, it has also been observed that the resulting material has a decrease in tendency to smoke over products made using virgin crude.

What is claimed is:

1. A method for enhancing the physical properties of an asphalt product, comprising:

vacuum distilling a blend of a high boiling petroleum fraction having an initial boiling point of at least 270° C. and essentially no asphaltene content and a crude to produce a product asphalt having a flash of from 265 to 300° C. and a mass loss of less than 1 wt. %.

2. The method of claim 1 wherein the crude is selected from virgin whole crudes and atmospheric distilled residuum of crude.

3. The method of claim 1 wherein the high boiling petroleum fraction is selected from a heavy vacuum gas oil in an amount of 5–30% by volume based on the whole crude.

4. The method of claim 3 wherein the amount of high boiling petroleum fraction is from 15–25% by volume based on the whole crude.

5. The method of claim 3 wherein the high boiling petroleum fraction has a hydrogen-to-carbon molecular ratio greater than 1.4.

6. The method of claim 3 wherein the high boiling petroleum fraction has an aromatics content of less than 85%.

7. The method of claim 1 wherein the product asphalt has a kinematic viscosity of 500 to 1500 cSt at 100° C.

8. The method of claim 1 wherein the product asphalt has a kinematic viscosity of 800 to 1000 cSt at 100° C.

9. The method of claim 1 wherein the product asphalt has a penetration of 100 to 600 dmm at 25° C.

10. The method of claim 1 wherein the product asphalt has a penetration of 200 to 400 dmm at 25° C.

* * * * *